United States Patent [19]

Stock

[11] 4,362,464

[45] Dec. 7, 1982

[54] TURBINE CYLINDER-SEAL SYSTEM

[75] Inventor: Alvin L. Stock, Wallingford, Del.

[73] Assignee: Westinghouse Electric Corp., Pittsburgh, Pa.

[21] Appl. No.: 180,769

[22] Filed: Aug. 22, 1980

[51] Int. Cl.[3] ..... F01D 25/26; F01D 25/24

[52] U.S. Cl. ..... 415/136; 415/108; 415/219 R

[58] Field of Search ..... 415/93, 95, 108, 136, 415/138, 202, 219 R

[56] References Cited

U.S. PATENT DOCUMENTS 3,746,463 7/1973 Stock et al. ..... 415/136

4,087,201 5/1978 Walsh et al. ..... 415/202

*Primary Examiner*—Harvey C. Hornsby

*Assistant Examiner*—A. Dahlberg

*Attorney, Agent, or Firm*—G. H. Telfer

[57] ABSTRACT

A multi-stage axial flow steam turbine having an inner and an outer casing. The inner casing being a pressure vessel having a first end which is enclosed by a nozzle ring disposed around a rotor in closely spaced, sealed relation therewith and having a second end which is open to the interior of the outer casing. Sealing between the inner casing and nozzle ring is provided by a structural hook seal which includes mateable flange portions which are integral with the inner casing and nozzle ring. A control stage and a first plurality of reaction stages are disposed within the inner casing. A second plurality of reaction stages are also disposed between the outer casing and the rotor so that steam leaving the inner casing's second end flows over the inner casing's outer surface and over the nozzle ring's outer surface to cool those outer surfaces before the steam enters the second plurality of reaction stages. The inner casing is mounted in the outer casing in such a manner as to limit relative axial movement and allow free relative radial movement induced by temperature differences between the inner and outer casings. The nozzle ring includes a plurality of nozzle chambers structurally connected and sealed together. Structural jointure between the nozzle ring and inner casing is provided by the hook seal which prevents axial separation thereof and reduces the size of the mounts necessary to support the nozzle ring and inner casing from the outer casing.

6 Claims, 3 Drawing Figures

TURBINE CYLINDER-SEAL SYSTEM

BACKGROUND OF THE INVENTION

This invention relates to multi-stage axial flow turbines, and more particularly, to such turbines having an inner and an outer casing.

One of the basic problems facing the turbine designer is introducing high pressure and high temperature elastic fluid such as steam into the main turbine casing before the steam is expanded through the blades of the turbine to do work. The process of expanding the steam produces work and reduces the temperature and pressure of the steam. Containment of the high temperature and pressure steam requires heavy wall containment vessels and casings having very large diameter bolts at horizontal joints as the casing are necessarily made in halves to provide easy access to the internals of the turbine and to facilitate assembly and maintenance. The high and varying temperature steam contained within the casing introduces thermal gradients across the thick walls thereof. The thermal gradients produce differential thermal expansion across the thick walls causing thermal stresses which can produce plastic flow and distortion of the casing. These expansions and resulting distortions must be considered by the designer when setting the clearances between rotatable and stationary portions of the turbine. To reduce the thermal gradients across the thick-walled casings, multi-casing turbines have been developed to break down the pressure and temperature gradients across the individual casings so that each casing, which is free to expand individually, is subjected to lower differential temperature and pressure and thus can be made with thinner walls. Nozzle chambers have generally been disposed within the inner casing requiring a dimensionally large inner casing having heavy walls, additional weight, and higher cost.

U.S. Pat. No. 3,746,463 by Stock et al filed July 26, 1971 and assigned to the assignee of the present invention discloses an inner casing which houses stationary and rotatable blades and is situated within and is supported by the outer casing. A first axial end of the inner casing is open to the outer casing's interior while the second axial end is flexibly sealed to segmented nozzle chambers disposed around the turbine's rotor. Such arrangement has provided very reliable service, but is not amenable to providing complete sealing between the inner casing and the nozzle chambers since the nozzle chambers were segmented. The support arrangements for the inner casing and nozzle chambers provided support for those structures' weight and axial thrust exerted thereon by the expanding steam's reaction forces. Due to such large and costly support arrangements, a reduction in the size thereof and improvement in the sealing between the inner casing and nozzle chambers is desired. Such size reduction would reduce costs and such seal improvement would increase turbine efficiency and provide greater reliability.

SUMMARY OF THE INVENTION

In general an axial flow turbine made in accordance with the present invention comprises a rotor, an outer casing, an inlet nozzle ring disposed within the outer casing circumferentially about the rotor, an inner casing disposed within the outer casing, wherein the inner casing has a first end open to the outer casing's interior and a second end which is sealed to the inlet nozzle ring by flange structures constituting portions of both the inner casing and nozzle ring. The nozzle ring includes a plurality of nozzle chambers rigidly joined together and a flange structure having an axial and radial component. The inner casing includes a flange structure having an axial and a radial element. The inner casing's radial element protrudes in the opposite radial direction as the nozzle ring's radial component. The radial component and radial element radially overlap and axially engage to effectively seal the inner casing to the nozzle ring and structurally connect them. Axial engagement of the flange structures permits transmission of axial loads between the nozzle ring and the inner casing so as to balance loads imposed thereon and provide more effective support for each with supports of smaller size. The flange structures of the nozzle ring and the inner casing appear as a hook arrangement with the radial element of the inner casing being arranged in closely spaced, axially adjacent relation with the nozzle ring so as to ensure retention of nozzle blocks to the nozzle chambers. The present invention turbine also includes at least one row of stationary and one row of rotatable blades disposed between the outer casing the the rotor such that steam exiting the inner casing's open, unsealed end flows over the outer surface of the inner casing and the nozzle ring before entering such blades.

BRIEF DESCRIPTION OF THE DRAWINGS

The objects and advantages of the present invention will become more apparent from reading the following detailed description in connection with the accompanying drawings, in which.

DESCRIPTION OF THE PREFERRED EMBODIMENT

Figure 1:
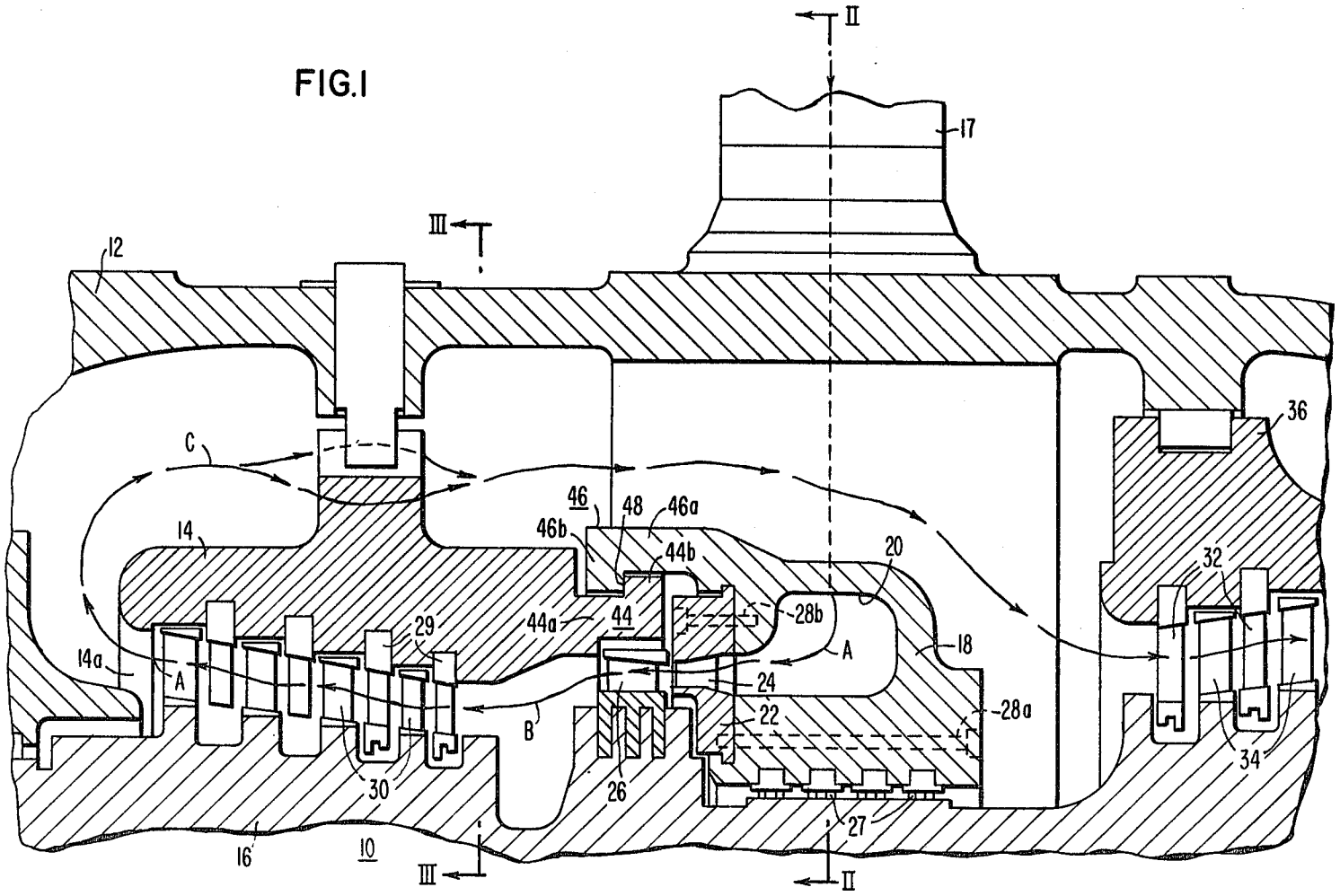
FIG. 1 is a partial sectional view of an axial flow steam turbine made in accordance with the present invention.

Referring now to the drawings in detail, wherein like numerals and letters indicate like elements and directions, respectively, FIG. 1 shows a partial sectional view of an axial flow steam turbine 10 having an outer casing or cylinder 12, an inner casing or "mini-cylinder" 14, a rotor 16, inlet nozzle 17, and nozzle ring 18.

Nozzle ring 18 includes a plurality of inlet nozzle chambers 20 each which is in fluid communication with an inlet nozzle 17 and is disposed within the outer casing 12. The nozzle chambers 20 are rigidly connected to form the nozzle ring 18 which is circumferentially disposed around rotor 16. Such rigid connection of the separate nozzle chambers 20 may be better seen in FIG. 2. Nozzle chambers 20 manifold motive steam to nozzle blocks 22 through which the steam is initially expanded. A typical steam flow path from inlet nozzle 17 to nozzle block 22 is indicated by arrows A. Each nozzle block 22 includes a plurality of stationary vanes 24 which control the expansion of the steam and impart the desired directional flow to the steam prior to its entry and subsequent expansion through control stage rotatable blades 26 which are connected to rotor 16. A plurality of radially inner connectors **28*a* and a plurality of radially outer connectors 28*b* secure nozzle blocks 22 in contact with nozzle chambers 20. Labyrinth seals 27 are disposed between nozzle ring 18 and rotor 16** so as to minimize steam leakage therebetween.

Subsequent to such initial expansion, the steam expands through alternating annular arrays of stationary nozzle vanes 29 and rotatable turbine blades 30 so as to impart motion to the rotatable turbine blades 30 and thus to rotor 16 for the purpose of doing useful work. After undergoing a partial expansion, the steam exits mini-cylinder 14 through exit annulus 14*a*, passes into flow area 31 as defined by mini-cylinder 14, nozzle ring 18, and outer cylinder 12. A typical flow path which the steam follows during such partial expansion from nozzle block 22 to exit annulus 14*a* is indicated by arrows B. The partially expanded steam cools the exterior surfaces of mini-cylinder 14 and nozzle ring 18 by sweeping thereacross as it passes through flow area 31 prior to being further expanded through alternating annular arrays of stationary blades 32 and rotatable blades 34 which are respectively connected to outer cylinder blade ring 36 and rotor 16. The steam follows typical flow paths such as are indicated by arrows C in traversing flow area 31 from exit annulus 14*a* to stationary blades 32. After further expansion through stationary and rotatable blades 32 and 34, respectively, the steam is normally directed to other turbine expansion stages, to a heat recovery or heat rejection device, or to any other desired low pressure sink.

Flange portion 44 of mini-cylinder 14 includes an axial element 44*a* and a radial element 44*b* which is disposed in closely spaced axial relationship with the radially outer nozzle block connectors 28*b* to prevent their loosening and withdrawal during turbine operation. Nozzle ring 18 also has a flange portion 46 which includes an axial extending component 46*a* and a radially extending component 46*b*. Radial element 44*b* and radial component 46*b* extend in opposite radial directions from their complementary axially extending flange element 44*a* and component 46*a*, respectively, and are engageable at an axial interface 48. Flange portions 44 and 46 together constitute a "hook seal" which is highly effective in preventing high pressure motive steam leakage out of the enclosure formed by mini-cylinder 14 and nozzle ring 18. Reaction forces from the motive steam act to the right (as illustrated in FIG. 1) on nozzle ring 18 and to the left on mini-cylinder 14 and associated stationary nozzle vanes 29. Due to axial engagement at interface 48 between the mini-cylinder 14 and nozzle ring 18, only the unbalanced reaction forces on the nozzle ring 18 and connected mini-cylinder 14 must be accounted for in their respective support keys 50 and 52 and thus a concomitant reduction in support key size is realized.

Figure 2:
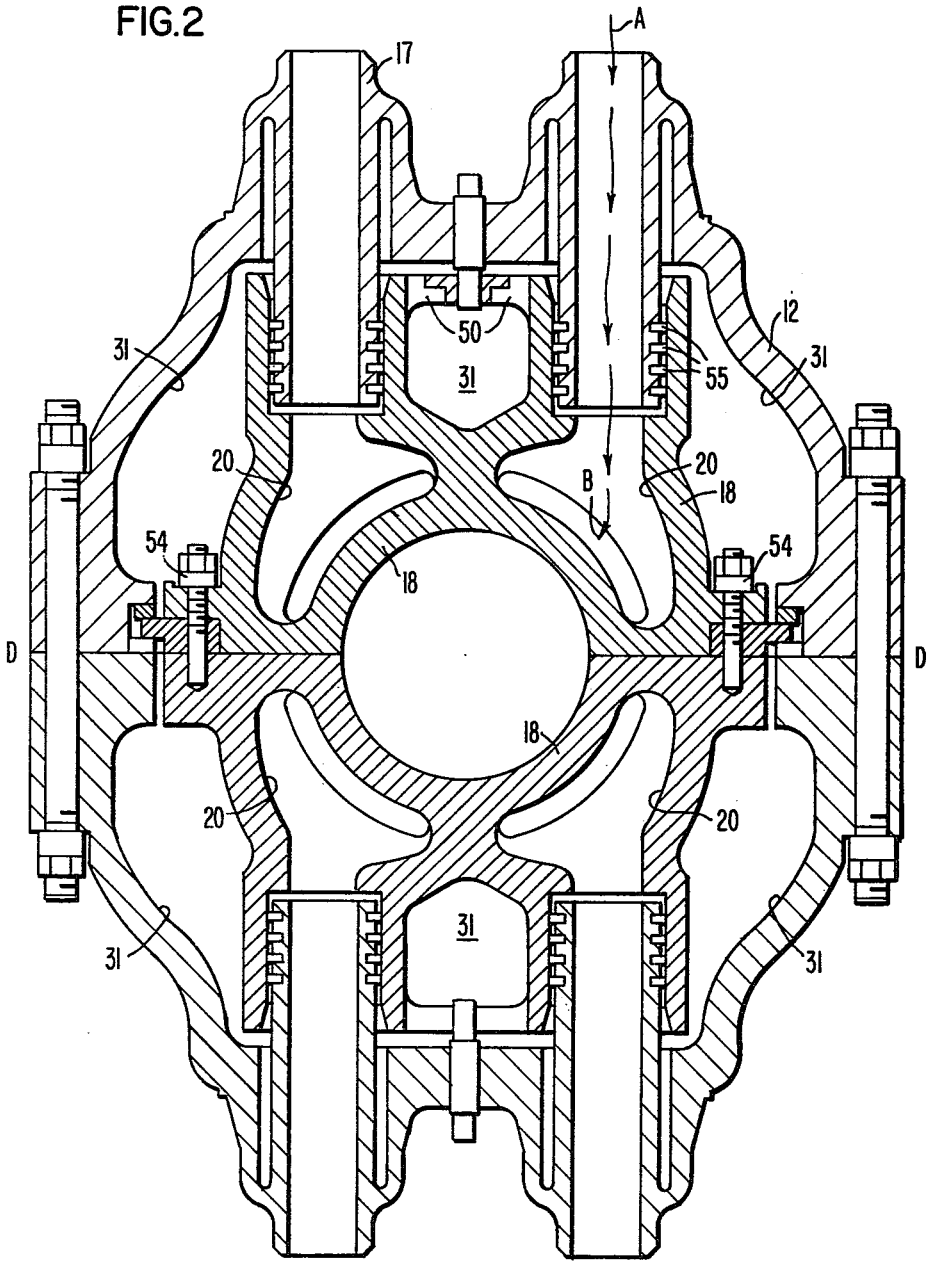
FIG. 2 is a sectional view taken along line II—II of FIG. 1.

FIG. 2 is a partial sectional view taken along line II—II of FIG. 1 and may be seen to include the stationary turbine structure above and below the turbine rotor 16 even though only the stationary structure above rotor 16 is illustrated in FIG. 1. The turbine rotor 16, however, has been deleted from FIG. 2 for the sake of clarity. Nozzle ring 18 includes by example four nozzle chambers 20 with two of each being grouped in an upper and a lower portion. The upper and lower portions of nozzle ring 18 are held together at a horizontal plane DD by fasteners 54. Sealing means such as rings 55 are disposed between nozzle ring 18 and inlet conduits 17 so as to permit telescopic movement of said inlet conduits 17 relative to the nozzle ring 18 and avoid inducing thermal stresses therein such as would obtain from rigidly connecting them. An exemplary inlet steam flow path is illustrated in FIG. 2 and shows steam entering inlet conduit 17 and traveling generally radially inwardly according to arrows A. Within nozzle chambers 20 the steam turns axially through stationary nozzle vanes 24 and continues in that general direction as indicated by arrow B (approaching viewer's vantage point) until the steam has passed through exit annulus 14*a* of mini-cylinder 14. The steam flow reverses its axial direction after passing through exit annulus 14*a* (not shown in FIG. 2) and passes through flow area 31 wherein the steam flow path therethrough is indicated as arrow C which is considered to be proceeding away from the viewer's vantage point.

Figure 3:
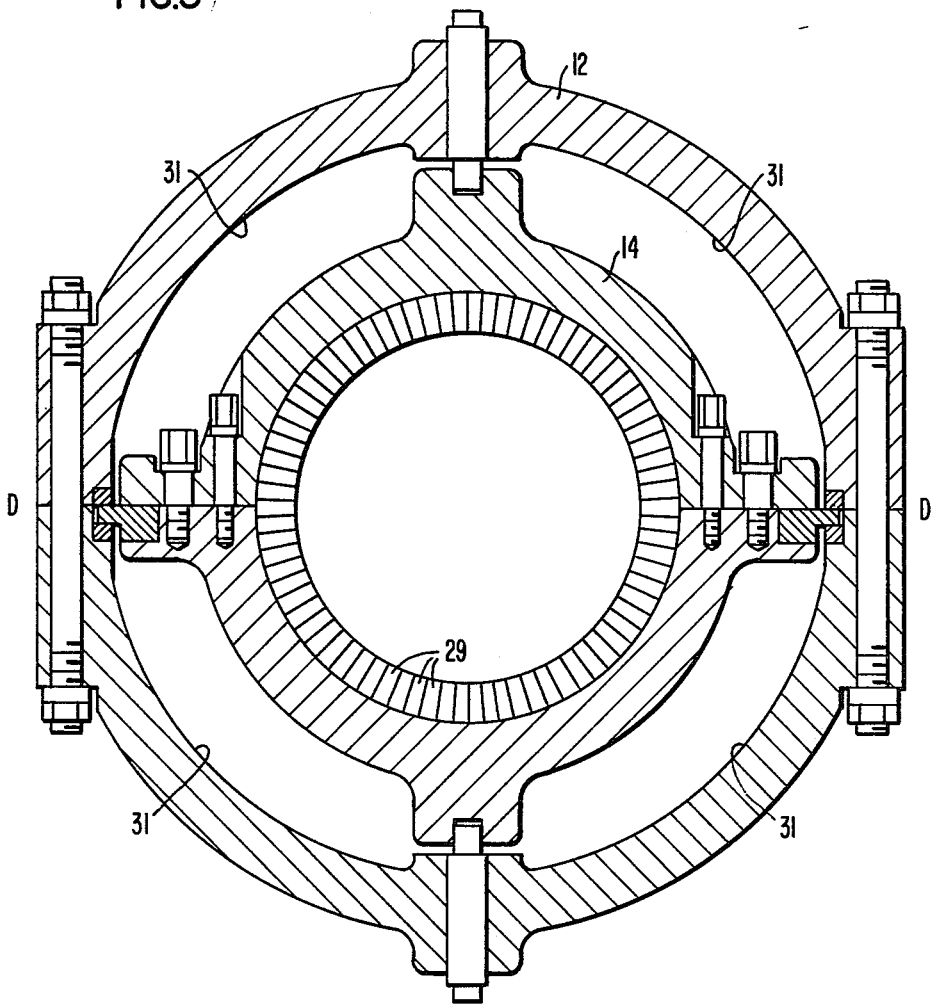
FIG. 3 is a sectional view taken along line III—III of FIG. 1.

FIG. 3 is a partial sectional view taken along line III—III of FIG. 1. Mini-cylinder 14 is supported within outer casing 12 and it, in turn, supports stationary nozzle vanes 29. Steam flow direction C through flow area 31 is also shown in FIG. 3. Outer casing 12 has means for aligning and supporting mini-cylinders 14. The partially expanded and thus relatively cool motive steam flows through passages 31 and sweeps the exterior surfaces of mini-cylinder 14 and nozzle ring 18 so as to cool those parts which are heated by the relatively hot, high pressure motive steam passing therethrough.

The present invention's structure permits elimination of the normal, large inner cylinder, elimination of large inner cylinder dummy rings for split flow design and blade rings for double flow design as well as elimination of multiple, flexibly mounted, separate weld-in nozzle chambers. The overall size and dimensions of the outer cylinder for a utilizing turbine has an outside diameter reduction of approximately 20%. Additionally, the dimension between rotor bearings on a turbine such as is illustrated in FIG. 1 is reduced approximately 25%. Also, the weight of the present invention turbine is estimated to be approximately 50% of the weight of most prior art designs. Elimination of nozzle chamber welds permits substantial cost reductions in the production, erection, and maintenance of the present invention turbine over that of prior art designs.

Significant reliability improvements are obtained from the present invention since the multiple welded, cantilevered nozzle chambers of prior art design are eliminated as is the potential for nozzle chamber vibration and associated fatigue failure. The nozzle ring 18 and mini-cylinder 14 are not susceptible to vibration since these parts are substantial masses which are mounted on frictionally damped support surfaces. Finally, the hook seal design for the interconnection between nozzle ring 18 and mini-cylinder 14 provides a more effective, reliable structure for sealing the steam in the control stage nozzle block area than existed in prior art turbines since the nozzle chambers 20 of the present invention are intimately joined together. An additional advantage of the hook seal design is that the radially outer row of nozzle block connection devices 28*b* are restricted in their movement by the axially adjacent radial element 44*b* of mini-cylinder 14.

What is claimed is:

1. An axial flow elastic fluid turbine comprising:

a rotor;

an outer casing;

an inlet nozzle ring disposed within said outer casing circumferentially about said rotor with a radial separation space between said nozzle ring and said rotor, said inlet nozzle ring having upper and lower portions each of which includes a plurality of nozzle chambers rigidly joined together, said nozzle ring having a first flange portion which includes an axially extending component and a radially extending component joined thereto; and an inner casing supported within said outer casing and disposed circumferentially about said rotor, said inner casing having first and second axial ends, said first end being disposed axially adjacent said nozzle ring and said second end opening into said outer casing, said first end having a second flange portion which includes an axially extending element and a radially extending element joined thereto, said radial extending element protruding in the opposite radial direction as said radial extending component, said first and second flange portions cooperating to seal and structurally interlock said inlet casing to said nozzle ring, said radial element being radially adjacent said axial component and axially adjacent said radial component, said radial component being axially engagable with said radial element.

2. The turbine of claim 1 further comprising:

at least one row of stationary blades and at least one row of rotatable blades disposed between and respectively joined to the outer casing and the rotor, said blades being so disposed that elastic fluid exiting said inner casing's second end flows over the outer surface of said inner casing and said nozzle ring before entering said blades.

3. The turbine of claim 1 further comprising:

means for sealing the radial separation space between the nozzle ring and rotor.

4. The turbine of claim 1 further comprising:

an elastic fluid inlet conduit in fluid communication with each nozzle chamber, said conduit extending through said outer casing and being fastened thereto.

5. The turbine of claim 4 further comprising:

means for sealing said conduit to the nozzle chamber fluidly communicating therewith, said seal permitting telescoping movement of said conduit relative to its nozzle chamber.

6. The turbine of claim 1, said nozzle ring further comprising:

a plurality of nozzle blocks each of which include a plurality of stationary vanes for directing the elastic fluid in a predetermined direction; and a plurality of radially inner fasteners for securing said nozzle blocks to said nozzle chambers, said fasteners being disposed radially between said nozzles and said rotor wherein said inner casing's radial element is axially engageable with said nozzle blocks at a position radially outside said nozzles.

* * * * *